United States Patent [19]

Sawicki

[11] Patent Number: 4,545,494

[45] Date of Patent: Oct. 8, 1985

[54] TAMPER INDICATING COVER

[76] Inventor: Nina P. Sawicki, 8347 Ranchito Ave., Panorama City, Calif. 91402

[21] Appl. No.: 591,223

[22] Filed: Mar. 6, 1984

Related U.S. Application Data

[62] Division of Ser. No. 467,103, Feb. 16, 1983.

[51] Int. Cl.[4] ..... B65D 41/54

[52] U.S. Cl. ..... 215/232; 215/246; 215/251; 215/257

[58] Field of Search ..... 215/246, 257, 230, 255, 215/232

[56] References Cited

U.S. PATENT DOCUMENTS

| | | | |
|---|---|---|---|
| 1,038,023 | 9/1912 | Switzer | 215/257 X |
| 2,119,901 | 6/1938 | Beitler | 215/246 |
| 2,121,041 | 6/1938 | Morgan | 215/246 X |
| 2,432,132 | 12/1947 | Allen | 215/257 X |
| 3,189,208 | 6/1965 | Jowett | 215/246 |
| 3,927,784 | 12/1975 | Cochrane | 215/258 X |

FOREIGN PATENT DOCUMENTS

| | | | |
|---|---|---|---|
| 730494 | 5/1932 | France | 215/246 |
| 1283453 | 12/1961 | France | 215/254 |

*Primary Examiner*—Donald F. Norton

*Attorney, Agent, or Firm*—Nilsson, Robbins, Dalgarn, Berliner, Carson & Wurst

[57] ABSTRACT

A tamper indicating cover seals the closure end of a capped container. The cover is secured to the container by means of a safety band secured within an annular indent in the container. The safety band has visual indicia different from the remainder of the cover so that when a pull tab on the safety band is pulled, the indicia-containing safety band is removed. As the safety band is removed, the remainder of the plastic cover is torn as a result of a helical tear line which may be a stress pattern or a thread embedded in or disposed underneath the plastic cover. The cover is secured to the container by heat fusing or other means between the safety band and the indent of the container.

5 Claims, 5 Drawing Figures

FIG. 1
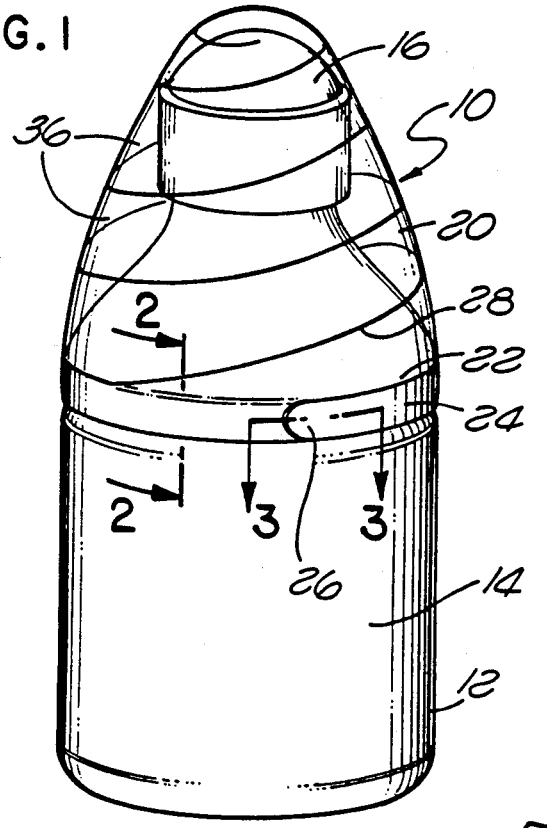
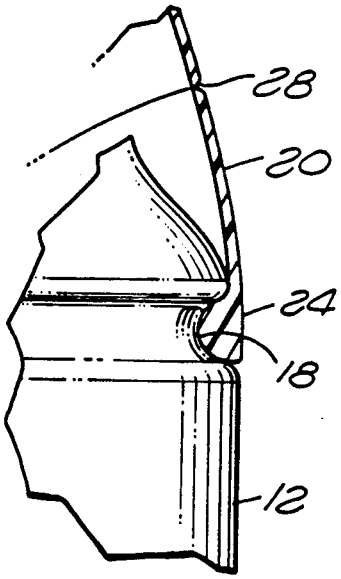
FIG. 2
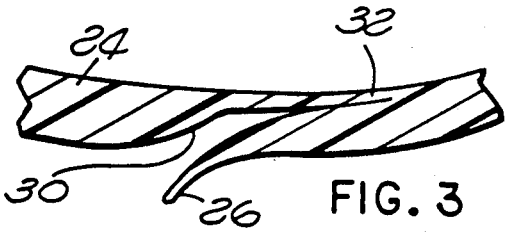
FIG. 3
FIG. 4
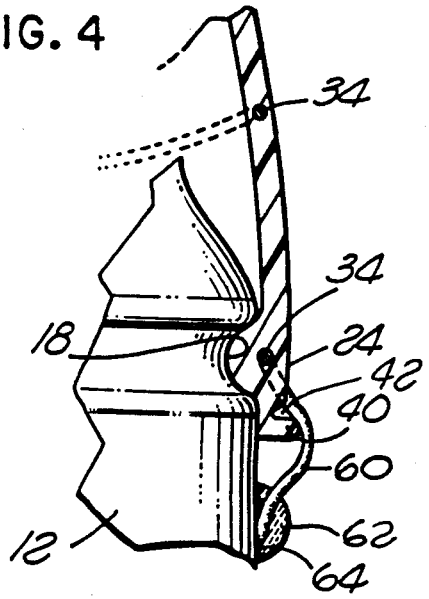
FIG.5
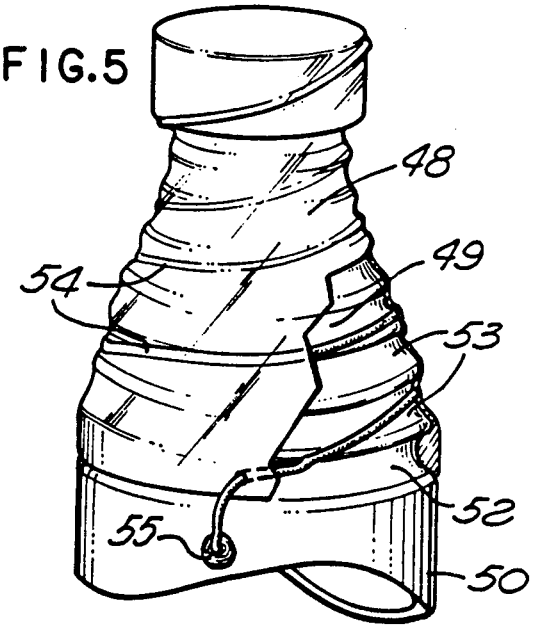

TAMPER INDICATING COVER

This is a division, of Application Ser. No. 467,103, filed Feb. 16, 1983.

BACKGROUND OF THE INVENTION

The present invention relates to apparatus for indicating when a container has been tampered with and more particularly comprises a cover affixed to a container with a conventional cap on the closure end of the container.

Recent events have dramatically demonstrated the need for improved tamper-resistant containers to prevent adulteration of the products in the containers. Heretofore, various closure devices have been developed which require the tearing of the cap placed on a container to effect opening of the container. Such closure apparatus are illustrated in Hutaff, U.S. Pat. No. 2,109,699; Langecker, U.S. Pat. No. 3,434,613; Faulstich, U.S. Pat. No. 3,392,860; Hermann, U.S. Pat. No. 834,906; Studer, U.S. Pat. No. 3,112,838; and Vido, United Kingdom Pat. No. 1,079,417. In each of these patents, the closure cap is either partially or entirely torn away. Consequently, the closure cap is either destroyed during the removal process making it impossible to reseal the container utilizing that cap or must have a special configuration so that a portion of the cap will be unaffected and can be used to reseal the container. None of these references show a cover for placement over the top of a container already having a cap thereon so that the cover prevents access to the cap.

In Sakurai, U.S. Pat. No. 3,640,417, a heat-shrinkable sleeve for closing a container is disclosed. However, the sleeve is provided to be placed underneath the cap. Hence, it would be impossible for a consumer to readily observe whether the sleeve had been removed or was still in place without removing the cap from the container. Consequently, the consumer could purchase a tampered with container and not know it.

By contrast, the present invention provides a cover which can be positioned over any of a number of different containers with conventional non-tamperproof caps thereon to effectively make the container tamper-proof. As such, the manufacture's bottle retains its identity in the eyes of the consumer. This is particularly true where the cover is provided to be either translucent or transparent so that the cap and top of the container can be observed by the consumer through the tamper resistent cover.

More specifically, the invention includes a cover which may be either a dome-shaped shroud member or a heat-shrink shroud member which covers the top of a container including the conventional cap closing the container. At the lower edge of the shroud portion of the cover, a safety band which is a thickened annular portion made out of the same material as the upper shroud portion, is provided to extend into an indent in the container. The safety band is made of a different color or has indicia on it that defined indicia which do not appear on the shroud portion of the cover so that when the safety band is removed, it will be obvious to a consumer by merely observing the container.

Indeed, in order to remove the cover, a consumer must focus his attention on the safety band in order to effect removal of the safety band. Since, any tampering with the cover of the present invention would result in damage to that very safety band, the consumer's attention will focus on the very item that must be effected by tampering. Hence, the consumer will be more likely to notice tampering.

The cover, in accordance with the invention, is such that when the pull member is pulled, the safety band tears in such a way as to cause the cover itself to also tear along annular tear lines which may either have a circular or a helical configuration. In accordance with the invention, the safety band is heat bonded or adhesively bonded to the container annularly at the indent in the container so that the cover cannot be removed without tearing the safety band and hence the shroud. Therefore, once the pull tab has been pulled, the safety band and shroud of the cover will be torn making it impossible to repair the cover and replace it on the container without making such repair efforts obvious to an observer. Such attempts to repair would be a clear indication of tampering whereas a lack of damage to the cover would be a clear indication that the container has not been tampered with.

It will also be appreciated that by making the safety band of a different color or with different visually-observable indicia than the remainder of the cover, any attempt to remove the safety band and then replace the cover will be easily observable to the consumer since the different-colored safety band will be missing.

SUMMARY OF THE INVENTION

The present invention comprises a tamper-indicating cover for containers closed by a cap where the container has an annular indent at a spaced distance below the cap. The cover, in accordance with the invention, includes a shroud portion positioned entirely over the cap in access-preventing relationship to the cap. The shroud further has an annular terminus region from which an annular safety band extends. The annular safety band is integral with the shroud portion and is configured to extend into the annular indent of the container. The safety band and hence the cover is affixed by adhesive or other means to the container at the indent for preventing removal of the cover from the container without tearing the cover.

A pull tab may extend from the safety band for transversely rupturing and removing the safety band from the container indent when the pull tab is pulled to effect removal of the cover from the container and give access to the container cap. In one embodiment, the shroud portion of the cover includes at least one tear line extending from the safety band for enabling the shroud to be torn to facilitate loosening of the cover from the container when the pull tab is pulled. The tear line may comprise either a stress line in the cover or may comprise a thread such as a nylon thread embedded in the cover or positioned around the container between the container and the cover so that when the thread is pulled, the thread will be pulled through the cover to effect rupturing of the cover.

The safety band of the cover includes indicia different from the shroud for identifying the safety band from the shroud portion to indicate to the consumer when the safety band has been removed.

BRIEF DESCRIPTION OF THE DRAWINGS

A complete understanding of the present invention and of the above and other advantages thereof may be gained from a consideration of the following description of the preferred embodiments taken in conjunction with the accompanying drawings in which:

FIG. 1 is a side view of the container with a cover in accordance with the invention in position thereon.

FIG. 2 is a cross-section of the cover through section 2—2 of FIG. 1.

FIG. 3 is a cross-sectional view through section 3—3 of FIG. 1.

FIG. 4 is a partial cross-sectional view of a second embodiment of a cover in accordance with the invention.

FIG. 5 is a side view of a container where the cover is shrink-wrap and the pull tab is a piece of balled thread.

DETAILED DESCRIPTION

Referring initially to FIG. 1, a tamper-indicating cover 10 is attached to a container 12 which may contain a liquid such as cough syrup, mouth wash, or the like, drugs in pill or capsule form, or other substance such as hair colorings or tints, substances applied to the hair, scalp, or skin, substances or preparations sprayed into, inserted or dropped into body cavities. The container 12 includes a main body 14 which has a top closure end closed by a cap 16. In accordance with the invention, the container 12 has an annular indent 18 at a spaced location below the cap 16.

The cover 10 comprises a shroud portion 20 which, when in position on the container 12, extends upward from an annular junction or terminus region 22 just above the indent 18 of the container 12 to entirely cover the portion of the container above the indent 18 including the cap 16. Extending down from the terminus region 22 of the shroud portion 20 but integral with the shroud portion 20 is a safety band 24.

Referring to FIG. 2 in connection with FIG. 1, the safety band 24 comprises an annular band with an annular convex protrusion which extends into the indent 18 where it is fixed to the container 12 to immovably retain the cover 10 on the container 12. In order to assure that the cover 10 cannot be removed from the container 12, the safety band 24 may be suitably fused by heat or an adhesive to the container in the indent region 18 of the container 12. A pull tab 26 may be provided to extend from the safety band 24. The pull tab 26 is part of the safety band 24 so that when the tab 26 is pulled, the safety band 24 will tear transversely allowing the safety band to be pulled free from the indent 18, thereby breaking the attachment between the safety band 24 and the container 12. In accordance with one embodiment, as the safety band 24 is removed upon pulling of the pull tab 26, the safety band 24 will separate from the shroud portion 20 along the terminus region 22, thereby permanently separating the safety band 24 from the shroud 20 along at least a portion of the terminus region 22. The shroud portion 20 may also include one or more helical tear lines 28 along which the shroud portion 20 will tear upon pulling of the pull tab 26 to remove the safety band 24.

The safety band may be simply a thickened portion of the same material, such as plastic, from which the shroud 20 is formed. Referring to FIG. 3, the pull tab 26 in such an embodiment may be formed simply by a cut 30 into a region of the safety band with the portion of the safety band above the cut 30 defining the pull tab 26 and the portion of the safety band 24 below the cut 30 defining a weakened area 32 so that when the pull tab 26 is pulled, the weakened area breaches causing the transverse tearing of the safety band 24. Continued pulling causes the safety band to be separted from the container and pulled from the indent 18, thereby releasing the cover 10 and allowing access to the cap 16.

Referring to FIG. 4, in connection with FIG. 1, the safety band 26 may be configured to facilitate tearing in the desired direction by embedding a nylon thread which comprise the tear line. In such an embodiment, as the nylon thread 34 embedded in the safety band 24 is pulled, the safety band is strengthened by the nylon thread and will be pulled without transverse tearing. The thread 34 can also be embedded in the shroud portion 20 in a helical configuration so that further pulling causes the thread to pull from the thinner shroud portion 20 causing the shroud portion 20 to tear along the helical tear lines into one or more tear strips 36.

In an alternative embodiment, the thread can be embedded in the shroud portion in a helical configuration and extend to be embedded in the safety band. An exposed portion 60 of the thread extends from the safety band and terminates in a balled portion 62 which is adhesively attached by a suitable adhesive 64 to the outside surface of the container 12. The balled portion 62 may simply be the nylon cord wound in a ball or may comprise a plastic rubber or other mass which is affixed to the end of the protruding thread 60. In such an embodiment, the cover may be removed by pulling the balled portion 62 from the surface of the container 12 by rupturing the adhesive bond 64 and thereafter pulling on the balled portion. The nylon thread will then pull free from its embedded position in the safety band or alternatively will pull the safety band from the indent region 18. The safety band will thereafter be pulled from the shroud region as the balled portion 62 is further pulled.

Because of the above-described tearing of both the shroud and the safety band from the shroud, it can be seen that the cover 10 will have multiple tears which will be difficult if not impossible to repair without making such repairs obvious to the purchaser. Thus, the purchaser is alerted to a container which has been tampered with.

In accordance with the invention, the safety band 24 is further provided to have visual indicia different from that of the shroud portion 20. Thus, if the safety band 24 is removed, any replacement of the shroud 20 after tampering will be obvious to the purchaser since the safety band having the different visual indicia will be missing. For example, in one embodiment, the indicia on the safety band 24 may be an opaque red color while the shroud portion 20 may be a transparent clear plastic. Thus, removal of the safety band 24 will cause the red band to be removed, making any attempt to remove the safety band 24 and then replace the shroud 20, obvious to the purchaser because the red indicia band will be missing.

In an alternative embodiment, the helical tear lines may simply be weakened portions of the shroud such as grooves as illustrated in FIG. 2. Thus, when the safety band 24 is pulled, the shroud portion 20 will be torn along the grooves 28 to effectively release the cover from the container 12 and allow access to the cap 16. Any attempt by a person other than the purchasing consumer to remove the cover and tamper with the contents of the container 12 will permanently destroy the cover 10 thus making tampering obvious to the purchaser.

Referring again to FIG. 4, the illustrated embodiment includes a lower annular ridge 40 extending from the safety band. The ridge 40 is attached or otherwise fused to the container 12 at a location immediately below the indent 18. In operation, when the pull tab or balled portion 62 as shown in FIG. 4 is pulled, the safety band 24 tears lengthwise leaving the annular ridge 40 attached to the container 12 while the portion of the safety band 24 extending into the indent 18 is pulled free from the indent 18 to effect removal of the shroud portion 20 of the cover 10. In order to facilitate a separation of the safety band from the annular ridge 40, an annular groove 42 may be impressed between the annular ridge 40 and the safety band 24 thereby weakening the connection between the annular ridge 40 and the safety band 24 to make the required tearing easier. The fact that the annular ridge remains will remind consumers that the pull tab has been removed.

Referring to FIG. 5, yet another embodiment of the invention is disclosed where the shroud portion 48 is formed by heat shrink plastic material 49. Preferably, the portion of the container 50 above the indent 52 has multiple annular indents 53 or may have any other suitable relief pattern. When the heat shrink plastic comprising the shroud is placed over the top of the container 50 and the plastic heated, the plastic shroud portion will shrink and assume the relief features 53 of the container 50. Suitble tear lines 54 may be provided such as by providing a helical winding of nylon thread around the container prior to heat shrinking the shroud over the top of the container. The thread 49 wound around the container prior to heat shrinking the shroud 48 over the top of the container extends from beneath the safety band 52 and terminates in a balled member 55 which may be pulled to effect rupturing and hence removal of the cover in the manner previously described. The combination of the relief features 53 assumed by the shroud 48 in addition to the helical tear line 54 defined by the nylon thread will make duplication or repair of the shroud 48 virtually impossible giving consumers a clear indication if the container 50 has been tampered with. In general, the thread 54 will be wrapped around the container 14 in a manner so that the thread 54 will be in noncoincidence with the relief design 53 as illustrated in FIG. 5.

While the above description has been made with references to specific embodiments of the invention, it will be appreciated that various modifications and changes can be made without departing from the true spirit and scope of the invention. It is therefore the object of the following claims to cover all such modifications and variations as fall within the true spirit and scope of the invention.

What is claimed is:

1. A tamper-indicating cover for a container closed by a cap and having an annular indent at a spaced distance below the cap, the container further having a selected relief design thereon, the cover comprising:

a shroud portion positioned over the cap in access-preventing relationship thereto and having an annular junction region, the shroud portion being of a heat shrink composition which is shrunk wrapped to the container whereby the shroud conforms to the relief design of the container;

an annular safety band integral with the shroud portion and extending from the annular junction region of the shroud; and a thread extending from the safety band, in a helical orientation around the container toward the cap, underneath the shroud portion, and in noncoincidence with the relief design on the container the end of the thread protruding for being pulled to tear the shroud and enable removal of the shroud.

2. The cover of claim 1 further comprising a pull tab extending from the end of the thread for being pulled to effect removal of the cover from the container to give access to the container cap.

3. The cover of claim 2 wherein the pull tab comprises a balled member on the end of the thread, the end of the thread extending from the safety band, the balled member being removeably affixed to the container below the safety band.

4. A tamper-indicating cover for a container closed by a cap and having an annular indent at a spaced distance below the cap, the container further having a selected relief design thereof, the cover comprising:

a shroud portion positioned over the cap in access-preventing relationship thereto and having an annular junction region, the shroud portion being of a heat shrink composition which is shrunk wrapped to the container whereby the shroud conforms to the relief design of the container, the shroud having a least one helical tear line in the shroud extending from the safety band and being in noncoincidence with the relief design on the container, for enabling the shroud to be torn and removed from the container; and a thread extending from the safety band for being pulled to tear the shroud along the helical tear line to effect removal of the cover from the container and give access to the container cap.

5. The cover of claim 4 comprising a balled member on the end of the thread, the end of the thread extending from the safety band, the balled member being removeably affixed to the container below the safety band.

* * * * *